United States Patent [19]

Kelly et al.

[11] Patent Number: 4,699,029

[45] Date of Patent: Oct. 13, 1987

[54] WRENCH SOCKET

[76] Inventors: Michael W. Kelly, 1021 N. Prarie; Laura B. Patterson, 911 Dawes, both of Joliet, Ill. 60435

[21] Appl. No.: 895,314

[22] Filed: Aug. 11, 1986

[51] Int. Cl.[4] ..... B25B 13/06

[52] U.S. Cl. ..... 81/121.1; 81/124.3; 81/124.4; 81/177.85

[58] Field of Search ..... 81/124.3, 177.5, 121.1, 81/59.1–63.2, 124.2, 124.6, 177.85; 403/379, 378, 316, 318, 108

[56] References Cited

U.S. PATENT DOCUMENTS

| | | | |
|---|---|---|---|
| 1,433,163 | 10/1922 | Walters . | |
| 2,077,997 | 4/1937 | Hedene . | |
| 2,094,584 | 10/1937 | Cox | 81/124.4 |
| 2,304,038 | 12/1942 | Thompson . | |
| 2,326,317 | 8/1943 | Amtsberg . | |
| 2,581,095 | 1/1952 | Godmaire . | |
| 2,991,678 | 7/1961 | Adolphson | 81/124.4 |
| 3,635,106 | 1/1972 | Homs | 81/121.1 |
| 3,853,025 | 12/1974 | Komhyr . | |
| 4,189,976 | 2/1980 | Becker | 81/121.1 |
| 4,328,720 | 5/1982 | Shiel | 81/63 |
| 4,356,852 | 11/1982 | Smith | 81/58.1 |
| 4,357,845 | 11/1982 | Cornia | 81/125 |
| 4,520,697 | 6/1985 | Moetteli | 81/62 |

*Primary Examiner*—Frederick R. Schmidt
*Assistant Examiner*—Maurina Rachuba

[57] ABSTRACT

A wrench socket that has a driven end for receiving a driving wrench in an internal or female drive opening, a driving end for engaging a threaded fastener to transmit a driving torque to the fastener and an intermediate external or male drive surface area which can be engaged by a second driving wrench. A removable retaining member is provided to assure that the second wrench is held on the socket, and a series of sockets may be provided which have various sized driving ends, but all have identical sized female drive openings and identical sized male drive surface areas so that only a single sized first wrench or a single sized second wrench need to used to drive a range of sizes of threaded fasteners. The driving end can be in any form, such as a castellated opening, a female hex-shaped opening or a male hex-shaped projection.

11 Claims, 8 Drawing Figures

WRENCH SOCKET

BACKGROUND OF THE INVENTION

1. Field of the Invention

The present invention relates to tools for manipulating threaded fasteners and more particularly to a wrench socket for driving threaded fasteners such as nuts or bolts.

2. Description of the Prior Art

It is known in the art to use various types of sockets engagable with wrenches for driving threaded fasteners. For example, U.S. Pat. No. 4,520,697 discloses a number of different sockets 14–18 which are used to connect a ratchet wrench to a threaded fastener. The sockets generally have an inner or female drive which receives a drive member from a ratchet wrench, impact wrench or other wrench mechanism to transmit a torque from the wrench to the threaded fastener engaged by the socket such as the head of a screw or directly to a nut.

Threaded fasteners such as nuts, cap nuts or bolts are used in a wide variety of applications and in various sizes including sizes wherein the head of the threaded bolt or the nut may be several inches in diameter. In the installation or removal of these threaded fasteners, occasionally the fastener becomes jammed or otherwise immobile against the torque applied by the particular wrench being utilized. In such instance, it is common to remove the wrench and socket from the head of the threaded fastener (that is, the head of a bolt or the actual nut) and to place a slugging wrench over the head of the fastener to apply a greater torque to the fastener head. The slugging wrench has a radially extending arm with a large impact zone at one end which can be struck by a hammer or sledge to provide the increased torque. Alternatively a hydraulic wrench is utilized which also is placed over the head of the threaded fastener to apply a torque to the fastener.

A drawback in the present method of driving threaded fasteners and utilizing slugging wrenches or hydraulic wrenches to dislodge or tighten fasteners where necessary is that a separate slugging wrench or hydraulic wrench is required for each diameter of threaded fastener head being driven. Also, care must be exercised when utilizing a slugging wrench so that the wrench will not become disengaged from the head of the fastener when the impact zone is being struck by the hammer or sledge. Care must also be exercised to prevent the hydraulic wrench from becoming disengaged from the head of the fastener during a loosening or tightening operation.

SUMMARY OF THE INVENTION

The present invention provides for a wrench socket which has an internal or female drive at a first end to receive an impact wrench, ratchet wrench, hydraulic wrench or other wrench mechanism and a drive at an opposite second end, the drive being a hexagonal opening, a castellated opening, a male hex drive or other such type of drive for engaging a head of a threaded bolt or nut. Intermediate the two ends is provided an external or male drive which may be in the form of a hexagonal shape to receive a slugging wrench or a hydraulic wrench. A retaining cap is removably securable to the socket to assure that the slugging wrench or hydraulic wrench will not be dislodged from the socket during the tightening or loosening operating. Also, the attachment of the retaining cap may be accomplished by means of a retaining pin extending across the female drive opening in the first end. This arrangement would prevent the inadvertent insertion of the driving wrench into the socket while the slugging wrench is held onto the socket so that the socket is not inadvertently driven while the slugging wrench is still attached to it.

A further enhancement included within the scope of the invention is that while a series of sizes of such sockets may be provided through various size increments, the external male drive for the slugging wrench or hydraulic wrench can maintain a constant size over a wide range of sizes of the fastener drive at the second end so that a limited number of slugging wrenches or hydraulic wrenches will be required for a full range of socket sizes thereby reducing the number of wrenches over that required by the present practice of providing a separate wrench for each threaded fastener head size.

Other features and advantages of the present invention are set forth in greater detail below.

DESCRIPTION OF THE PREFERRED EMBODIMENTS

Figure 1:
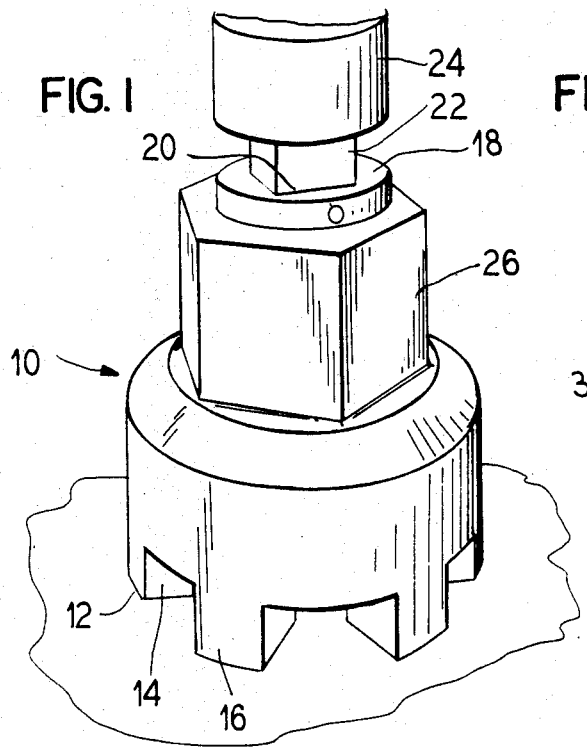
FIG. 1 is a perspective view of a socket embodying the principles of the present invention being driven by a wrench.

In FIG. 1 there is shown generally a socket 10 which is in the form of a castellated socket, that is, a fastener driving end 12 is provided with alternating notches 14 and projections 16 which are designed to mate with a conversely shaped threaded fastener bolt head or nut, commonly known as a castellated headed fastener. A top end 18 of the socket 10 has an internal or female drive opening 20 sized to receive a driving projection 22 of a wrench 24 such as an impact wrench, ratchet wrench or other wrench mechanism. The projection illustrated is a square head drive to be received in a square female drive opening 20, but other configurations of female drive openings 20 such as a splined opening may be provided depending on the particular configuration of the driving wrench to be utilized.

Intermediate the driving end 12 and the driven end 18 there is an external or male drive area 26 in the form of a hexagonal circumference which can receive a wrench having a hexagonal open end or a box-type wrench with a pair of opposed driving faces.

Figure 2:
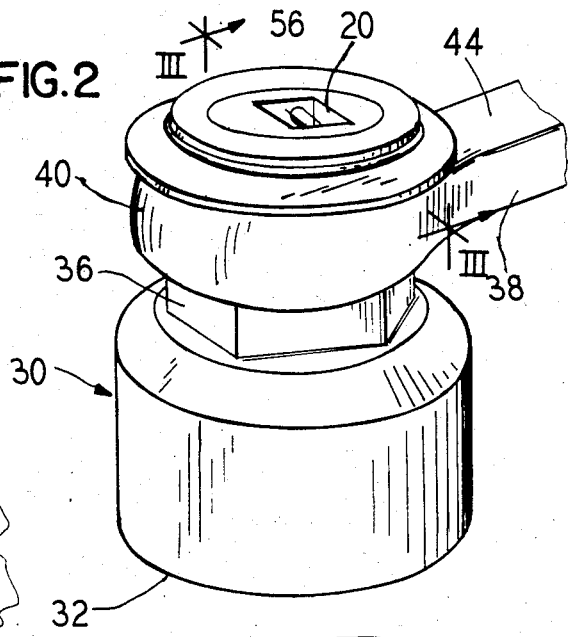
FIG. 2 is a perspective view of a socket embodying the principles of the present invention with a slugging wrench attached thereto.

FIG. 2 illustrates a second embodiment of a wrench socket 30 in which a driving end 32 has a continuous external circumference but has an internal opening 34 (seen in FIG. 3) to receive a threaded fastener head 35. Such opening may be a hexagonal opening or other configuration depending upon the threaded fastener to be driven. In all other respects, the socket 30 is substantially identical to that shown in FIG. 1 in that there is a male or external drive surface area 36 which can be engaged by a wrench 38.

Figure 5:
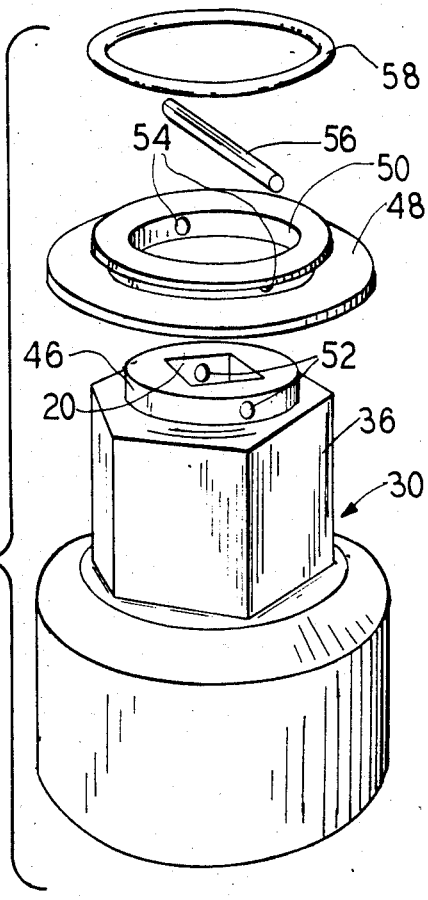
FIG. 5 is an expanded view of the elements comprising a socket assembly.
Figure 6:
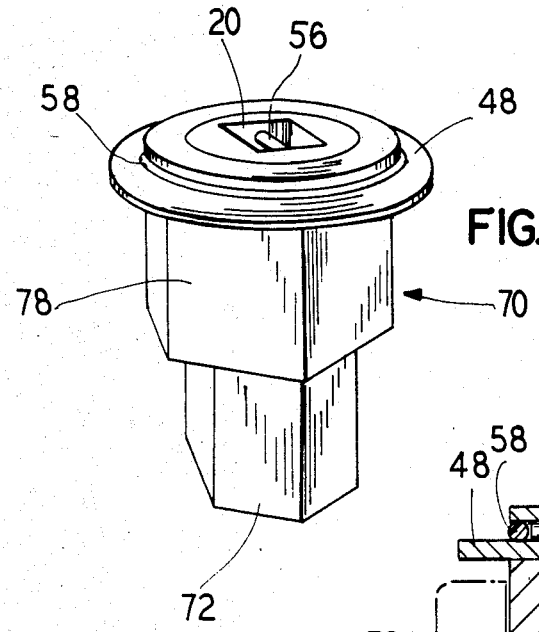
FIG. 6 is a perspective view of a socket embodying the principles of the presention invention.
Figure 7:
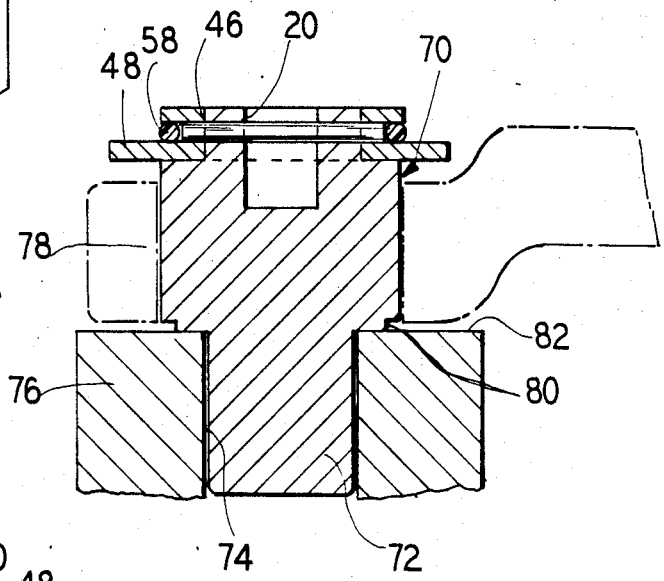
FIG. 7 is a side sectional view of the socket of FIG. 6.
Figure 8:
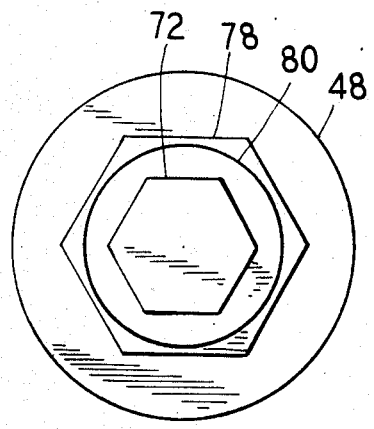
FIG. 8 is a bottom view of the socket of FIG. 6.

FIG. 5 illustrates a third embodiment or a wrench socket 70 in which a driving end 72 comprises an external hex or male hex drive. As illustrated in FIG. 6, the male hex drive 72 can be inserted into a complimentary shaped opening 74 in the head 76 of a threaded fastener in order for torque to be transmitted from the socket 70 to the fastener. An external or male drive area 78 is identical to areas 26 and 36 described above in that it is designed to receive a slugging wrench or hydraulic wrench or other types of wrenches. Between the male driving end 72 and the male drive area 78 there is provided a shoulder 80 formed as a raised ring between the male drive end and the male drive area which rides on a top surface 82 of the fastener head 76 being engaged to prevent any damage to the male drive area 78 caused by contact with the top surface 82 of the fastener. In all other respects, the socket 70 is substantially identical to that shown in FIG. 1. In that there is a female drive opening 20 formed in the top end of the socket 78.

As is described above, occassionally a slugging wrench is utilized to apply additional torque to a threaded fastener and the wrench 38 may be such a wrench. Alternately, a hydraulic wrench may be used to rotate the fastener, and such a wrench would have a socket engaging portion such as that illustrated at 38. The wrench 38 has a driving end 40 with an internal opening 42 (FIG. 3) to be received around the external drive area 36 of the socket 30. The wrench 38 has radially extending arm 44 with an impact zone at one end (if a slugging wrench) to be struck by a hammer or sledge to provide the increased torque to the threaded fastener head through the socket 30. In each of the illustrated embodiments the socket has a upwardly projecting circular extension or boss 46 at the driven end 18 to receive a retaining cap 48 which has an internal opening 50 sized to slip over the boss 46.

The boss has a pair of aligned openings 52 therethrough and the retaining ring has a pair of aligned openings 54 therethrough. Both sets of openings 52, 54 can be aligned by relative rotation between the retaining cap 48 and the socket 30 when the retaining cap 48 is placed over the boss 46. A retaining pin 56 can be inserted through both pairs of aligned openings 52, 54 to hold the retaining cap 48 onto the socket 30. A retaining ring 58 can be placed around the circumference of the cap 48 to assure that the retaining pin 56 will not become dislodged from the aligned openings 52, 54. Other arrangements for securing the cap 48 to the socket 30 could also be utilized.

Figure 3:
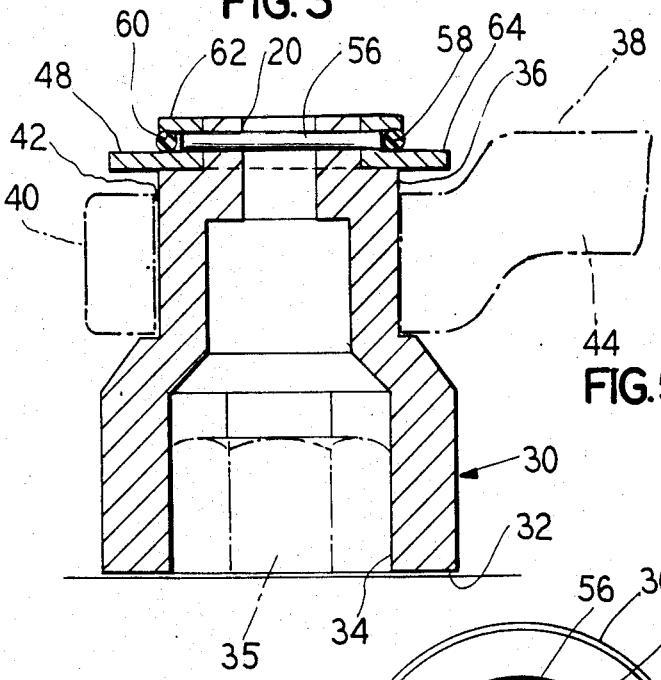
FIG. 3 is a side sectional view of a socket taken generally along the lines III—III of FIG. 2.

The retaining cap 48 is shown in cross section in FIG. 3. A recessed annular channel 60 is provided through which the openings 54 extend and which can receive the retaining ring 58. Thus, a top lip 62 prevents the retaining ring 58 from coming out of the channel 60. An enlarged diameter portion 64 of the cap 48 overlies the exterior drive area 36 of the socket 30 and prevents the wrench 38 from becoming disengaged from the socket 30.

Figure 4:
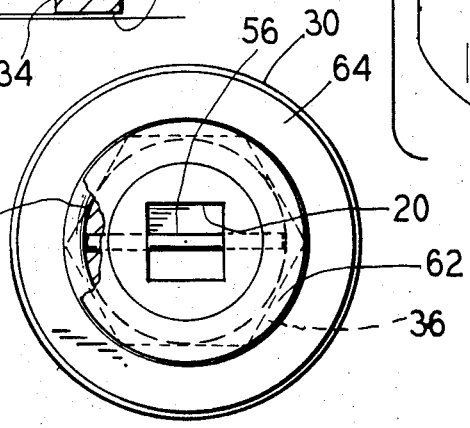
FIG. 4 is a top view of the socket of FIG. 3.

The retaining pin 56 extends across the internal drive opening 20 (as seen in FIG. 4) to provide the secondary function of preventing the driving projection 22 of the drive wrench 24 from being inserted into the socket 30 while the external drive wrench is 38 carried on the socket 30. In this manner, inadvertent rotation of the socket is prevented while the external drive wrench 38 is carried on the socket.

The external drive wrench can readily be removed from the socket by first removing the retaining ring 58 which may be in the form of an O-ring, sliding the retaining pin 56 from the aligned openings 52, 54 and lifting off the retaining cap 48. Then, the socket is available for use by the normal drive wrench 24 once the external drive wrench 38 has been removed.

Although individual sockets may be provided on a "custom" basis, a further feature of the invention is that the external drive surface 36 of the socket can be maintained constant over a range of drive openings 34 of the drive end 32 of the socket such that a limited number of external drive wrenches 38 would be required for a full set of sockets 30. Similarly, the internal drive opening 20 would remain constant or would be provided in a limited number of sizes throughout the entire range of sizes of the sockets such that a limited number of driving wrenches would be required to drive the sockets through the internal drive.

Therefore, it is seen that there is provided an improved wrench socket which can be driven by either an internal drive opening or an external drive surface area in which a limited number of drive wrenches are required for either the internal or external drives throughout a wide range of socket sizes. Further, a retaining system is provided to prevent the external drive wrench from becoming dislodged from the socket during operation and to prevent operation by the internal drive wrench while the external drive wrench is in place.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A wrench socket comprising:

a driven end having an internal drive opening therein to receive a driving projection from a first wrench;

a drive end having a drive means to engage a threaded fastener for rotatingly driving said fastener;

an external drive surface area intermediate said driven end and said drive end for receiving a second wrench in surrounding relationship;

a removable retaining member securely positionable between said driven end and said external drive surface area to assure selective retention of said second wrench on said socket; and means preventing insertion of said first wrench into said internal drive opening while said retaining member is secured to said socket;

whereby, said socket may be driven by either said first wrench through said internal drive opening or said second wrench through said external drive surface area.

2. A wrench socket according to claim 1 wherein said insertion prevention means comprises a retaining pin extending between said retaining member and said socket, said retaining pin projecting into said internal drive opening thus preventing insertion of said first wrench into said internal drive opening.

3. A wrench socket according to claim 2 including a retaining ring placeable around said retaining member to prevent said retaining pin from separating from said socket and retaining member.

4. A wrench socket according to claim 3 wherein said retaining member comprises a ring-shaped cap which has an annular channel in an outer circumferential surface thereof and a pair of aligned openings extending there through terminating in said annular channel, whereby said retaining ring is seatable in said channel to hold said retaining pin in place.

5. A wrench socket according to claim 1, wherein said socket has an internal hex-shaped opening as said drive means at said drive end.

6. A wrench socket according to claim 1, wherein said socket has a castellated drive opening as said drive means at said drive end.

7. A wrench socket according to claim 1, wherein said socket has an external male hex as said drive means at said drive end.

8. A series of wrench sockets comprising:

a plurality of socket members, each member having:

a driven end having an internal drive opening therein to receive a driving projection from a first wrench;

a drive end having a drive means to engage a threaded fastener for rotatingly driving said fastener;

an external drive surface area intermediate said driven end and said drive end for receiving a second wrench in surrounding relationship; and said internal drive opening and said external drive surface area each being constant in size throughout said series of sockets, while said drive means vary in size between each of said sockets in said series;

a removable retaining cap securely positionable between said driven end and said external drive surface area to assure selective retention of said second wrench on said socket; said retaining cap having an annular channel in an outer circumferential surface thereof, said cap surrounding a portion of said socket;

a first pair of aligned openings extending through a diameter of said cap, terminating in said annular channel;

a second pair of aligned openings extending through a diameter of said socket alignable with said first pair of openings;

a retaining pin insertable through said two pairs of aligned openings to retain said ring on said socket;

a retaining ring receivable in said channel to hold said pin in said openings;

whereby, a plurality of sizes of threaded fasteners can be driven by said series of sockets through the use of one of a single sized first wrench and a single sized second wrench.

9. A series of wrench sockets according to claim 14, wherein each of said socket members has an internal hex-shaped opening as said drive means in said drive end, the diameter of said hex opening varying between socket members.

10. A series of wrench sockets according to claim 8, wherein each of said socket members has a castellated drive opening as said drive means in said drive end, the diameters of said drive opening varying between socket members.

11. A series of wrench sockets according to claim 8, wherein each of said socket members has an external hex-shaped projection as said drive means in said drive end, the diameter of said hex projection varying between socket members.

* * * * *